US010226806B2

(12) United States Patent
Egerton et al.

(10) Patent No.: US 10,226,806 B2
(45) Date of Patent: Mar. 12, 2019

(54) CAN BODYMAKER

(75) Inventors: Daniel Egerton, Skipton (GB); William Woulds, Shipley (GB)

(73) Assignee: Crown Packaging Technology, Inc., Alsip, IL (US)

( * ) Notice: Subject to any disclaimer, the term of this patent is extended or adjusted under 35 U.S.C. 154(b) by 801 days.

(21) Appl. No.: 13/696,364

(22) PCT Filed: May 5, 2011

(86) PCT No.: PCT/EP2011/057237

§ 371 (c)(1),
(2), (4) Date: Jan. 15, 2013

(87) PCT Pub. No.: WO2011/138411

PCT Pub. Date: Nov. 10, 2011

(65) Prior Publication Data

US 2013/0108398 A1 May 2, 2013

(30) Foreign Application Priority Data

May 6, 2010 (EP) ..... 10162130

(51) Int. Cl.
*B21D 22/00* (2006.01)
*B21D 22/28* (2006.01)
*B21D 43/00* (2006.01)

(52) U.S. Cl.
CPC ..... *B21D 22/00* (2013.01); *B21D 22/28* (2013.01); *B21D 43/00* (2013.01)

(58) Field of Classification Search
CPC ..... B21D 43/00; B21D 22/00; B21D 22/28; B21D 51/2692; B21D 51/26; B21D 43/16; B21D 43/12; B21D 43/08; B21D 43/026; B65G 47/56; B65G 47/58; B65G 47/52; B65G 47/57
USPC ..... 413/1, 69, 70, 64; 72/347, 349, 417, 72/336, 337
See application file for complete search history.

(56) References Cited

U.S. PATENT DOCUMENTS 3,636,748 A * 1/1972 Hall ..... B21D 22/22 72/349
4,007,621 A * 2/1977 Franek et al. ..... 72/351
4,020,670 A 5/1977 Bulso et al.
4,034,692 A * 7/1977 Hennes ..... B21D 51/26 72/39
4,061,012 A * 12/1977 Wessman ..... B21D 22/30 72/347
4,183,238 A * 1/1980 Maillet ..... B21D 22/28 72/349
4,214,471 A 7/1980 Bulso et al.
(Continued)

FOREIGN PATENT DOCUMENTS

DE 2900423 A1 9/1979
GB 2019287 10/1979

*Primary Examiner* — Jimmy T Nguyen
(74) *Attorney, Agent, or Firm* — Baker & Hostetler LLP

(57) ABSTRACT

A can bodymaker, which includes a disc feed (1) for feeding a disc (5) directly to the bodymaker itself. A locator (9) positions the disc (5) centrally to a blankholder (12) and a draw pad (10) clamps the disc (5) against a draw die (11). The blankholder (12) then forms the disc into a cup (20) and clamps the cup against a redraw die (14) ready to be picked up by a punch and carried through dies for forming a can body.

9 Claims, 7 Drawing Sheets

(56) References Cited

U.S. PATENT DOCUMENTS

| | | | | | |
|---|---|---|---|---|---|
| 4,534,202 | A * | 8/1985 | Snyder | B21D 43/16 | 72/349 |
| 4,928,511 | A * | 5/1990 | Sirvet | B21D 43/14 | 414/797.7 |
| 5,431,038 | A * | 7/1995 | Cheers | B21D 43/16 | 72/361 |
| 5,566,567 | A * | 10/1996 | Main | B21D 43/14 | 72/361 |
| 5,997,198 | A * | 12/1999 | Murayama et al. | 400/624 | |
| 7,287,408 | B2 * | 10/2007 | Kawai | B21D 22/28 | 72/349 |
| 2006/0266092 | A1 | 11/2006 | Kawai | | |
| 2009/0100892 | A1 * | 4/2009 | Nardini | B21D 22/28 | 72/347 |

* cited by examiner

CAN BODYMAKER

TECHNICAL FIELD

This invention relates to a long stroke press or, as it is known in the can making industry, a bodymaker, for drawing hollow articles such as metal containers or cans.

BACKGROUND ART

In known bodymakers for the production of thin-walled metal cans by the so-called "drawing and wall-ironing" (DWI) process, cups are fed to the bodymaker and carried by a punch on the end of the ram, through a series of ironing dies to obtain the desired size and thickness of the can. Ultimately, the can body carried on the punch may contact a bottom forming tool so as to form a shape such as a dome on the base of the can.

The cup is mounted on the free end of a punch which extends from a reciprocating ram, and the cup wall is then "ironed" by passing through one or more ironing dies to lengthen the side wall of the cup and form a can.

In existing apparatus for the formation of a "two piece" container (i.e. one piece can body with side wall and base, and separate end component), a cupping press is first fed with a coil of metal, and then punches out discs and makes them into cups. The flat circular blanks or discs of metal are drawn through one or more drawing dies in the cupping press to form the shallow cups. The cups are then transferred to a bodymaker for conversion into the finished can body.

The cupping press is an enormous, and extremely expensive, machine. It is therefore an aim of this invention to provide alternative equipment and methods, which could replace or reduce the footprint (floor space) required by the conventional cupping press. By reducing or avoiding the need for the significant capital expenditure of the cupping press, it would become possible to eliminate the need to stock large coils, and all the scrap (the 'web') created by the cupper, which would normally have to be shipped back to the supplier to get the scrap value back, is avoided.

SUMMARY OF INVENTION

According to the present invention, there is provided a can bodymaker with a ram which carries a punch for forming a can from a cup and characterised by: a disc feed which is adapted to feed a metal disc directly into the bodymaker; a blankholder; a locator for positioning the disc centrally to the blankholder; a draw pad for clamping the disc against a draw die, and in which the blankholder is adapted to form the disc into a cup and to clamp the cup against a redraw die ready to be picked up by the punch on the ram and carried through one or more dies for forming a can body.

The bodymaker of the invention thus avoids all the expense and bulk of a traditional free-standing cupper. By using pre-cut discs there is no scrappage resulting from in situ forming of discs on a cupping press.

In one embodiment of the invention, the disc feed further includes two sets of rollers for gripping and driving the disc to the locator. The feed may also use a feed plate with spring-loaded element, such as a pawl, for holding the disc against the locator.

For high-speed manufacture, the disc may be positively located by a positioning cam and spring-loaded cushion. If there is a risk, for example that the draw pad might hit the cushion, one or more of the roller sets may be off-centre.

In an alternative bodymaker according to the invention, the discs may be un-lubricated and the disc feed may comprise a vacuum feed to separate the discs and a flighted belt to push the discs along. This alternative comprises, for example, a double sheet detector with sprayer, two belts and a turnover path for double-sided lubrication.

According to a further aspect of the present invention, there is provided a method of forming a can body comprising: feeding a disc directly into a can bodymaker; positioning the disc centrally to a blankholder; clamping the disc against a draw die; moving a blank holder into contact with the disc to form a cup from the disc; clamping the cup against a redraw die; picking up the cup on a punch on a ram; ironing the cup by carrying the cup through at least one die thereby forming the cup into a can body.

In one embodiment, the feeding step of this method may comprise moving the disc from the feed plate through rollers into the bodymaker.

Alternatively, the feeding step may involve lifting an unlubricated disc off the feed plate by vacuum and pushing the disc along a flighted belt; spraying lubricant on both sides of the disc; and pushing the disc into the bodymaker.

BRIEF DESCRIPTION OF DRAWINGS

Preferred embodiments of the invention will now be described, by way of example only, with reference to the drawings, in which.

DESCRIPTION OF EMBODIMENTS

Figure 1:
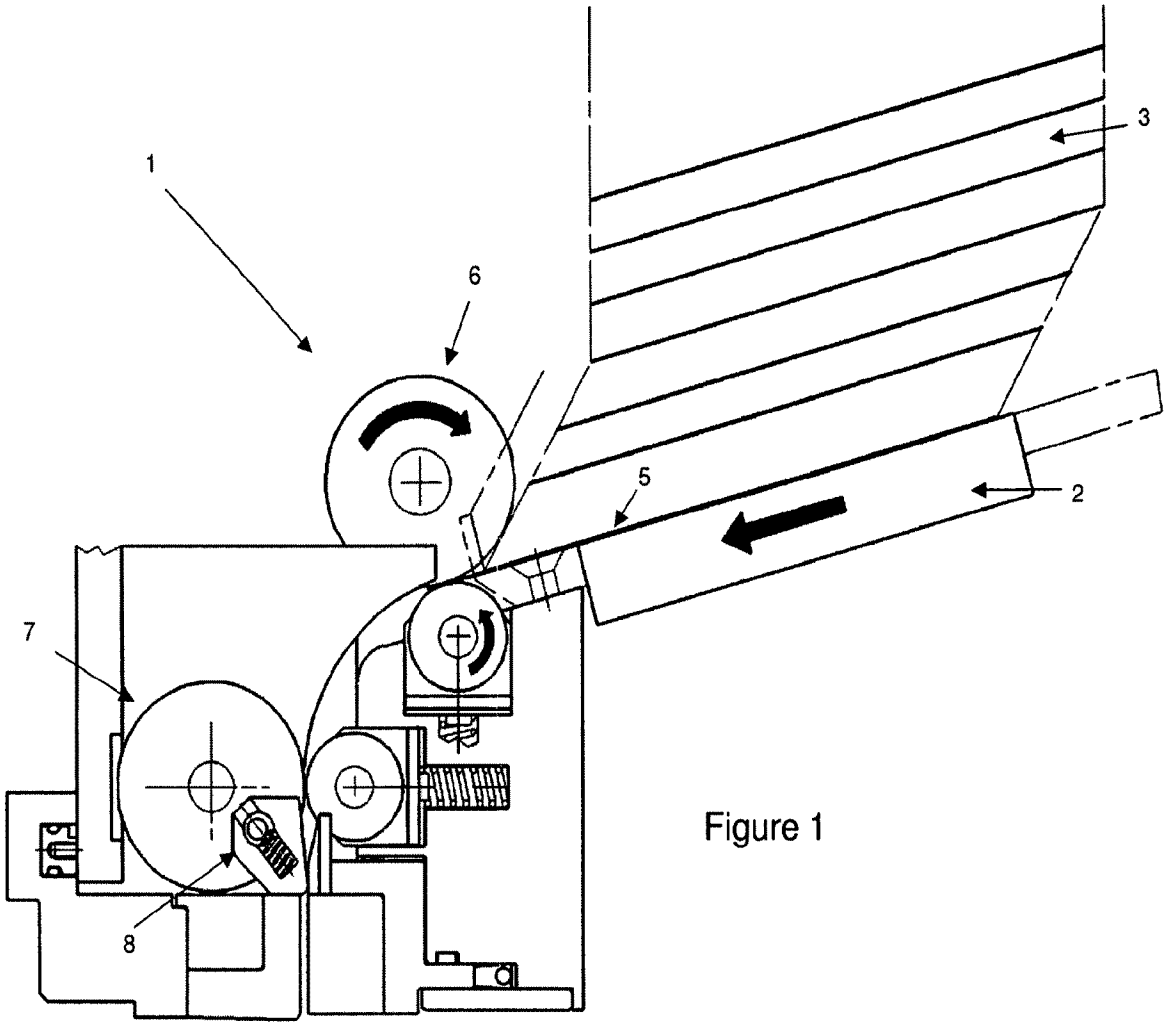
FIG. 1 is a schematic side view of a disc feed which uses a feed plate and rollers.

The embodiment of FIGS. 1 to 7 uses a roller feed arrangement 1 and feed plate slide 2. The discs are stacked in a hopper 3, which is located above the infeed sitting on a dead plate. Down the centre of the dead plate is a slot with a short stroke slide. The slide would have a recess or spring-loaded finger or pawl, which would protrude the thickness of the disc 5.

When the slide 2 moves forward it pushes the disc into the top set of rollers 6 which grip the disc 5 and drive it forward around the guide to the second set of rollers 7. The rollers 6, 7 move the disc 5 around a small curve and are easy to drive. The large rollers of the pairs are driven and dictate the disc speed. The small rollers are spring-loaded to supply the nip for gripping the disc. The small rollers maintain contact with the disc or drive roller to avoid skidding.

Figure 2:
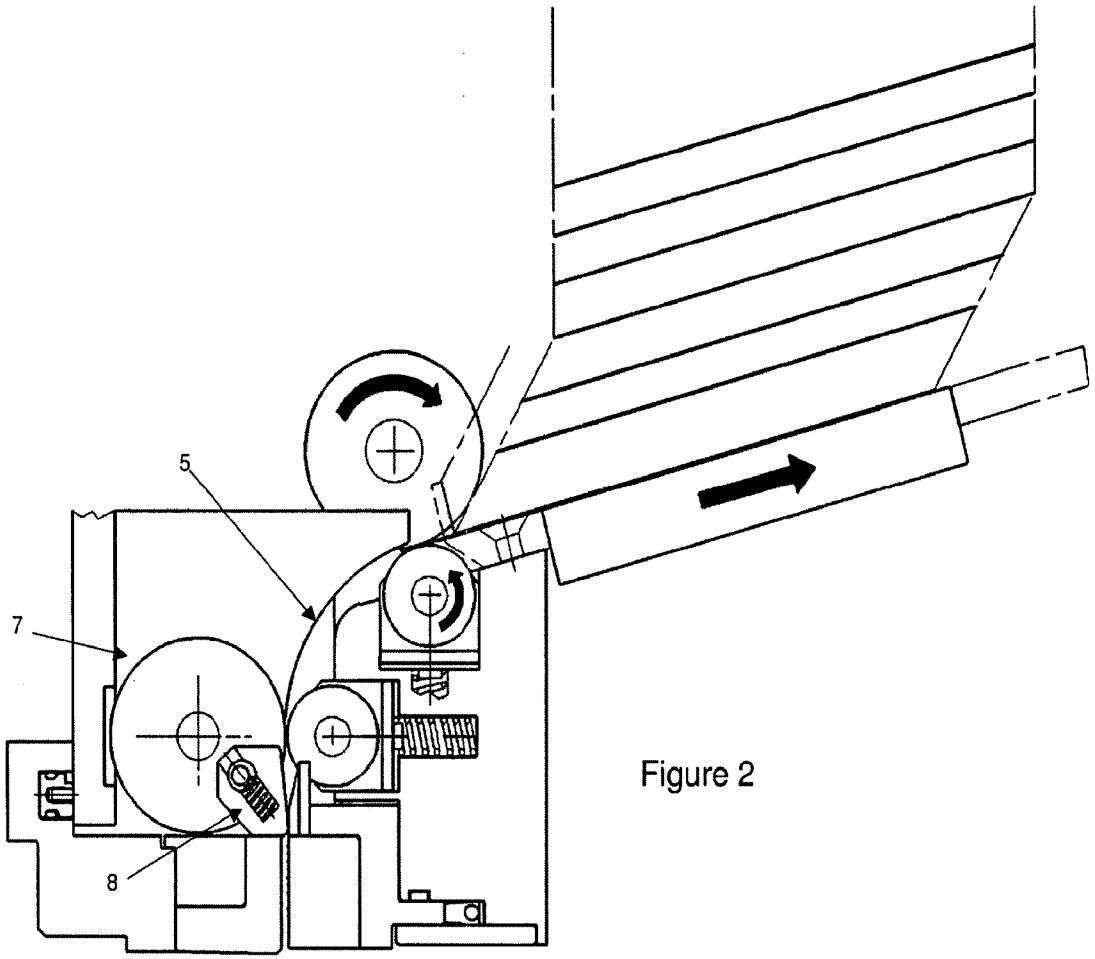
FIG. 2 is the disc feed of FIG. 1, showing the disc pushing back a pawl as it passes through the rollers.
Figure 3:
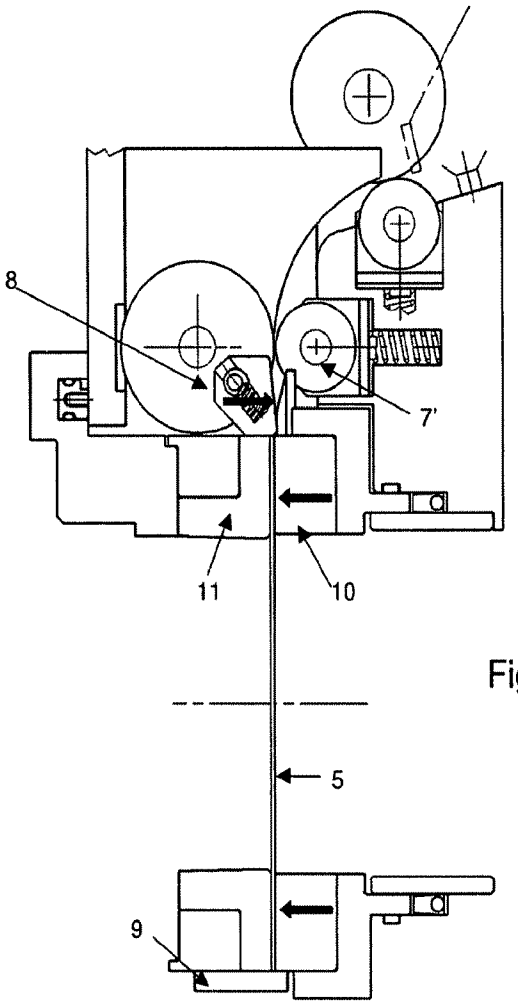
FIG. 3 shows the disc clamped by a draw pad.
Figure 4:
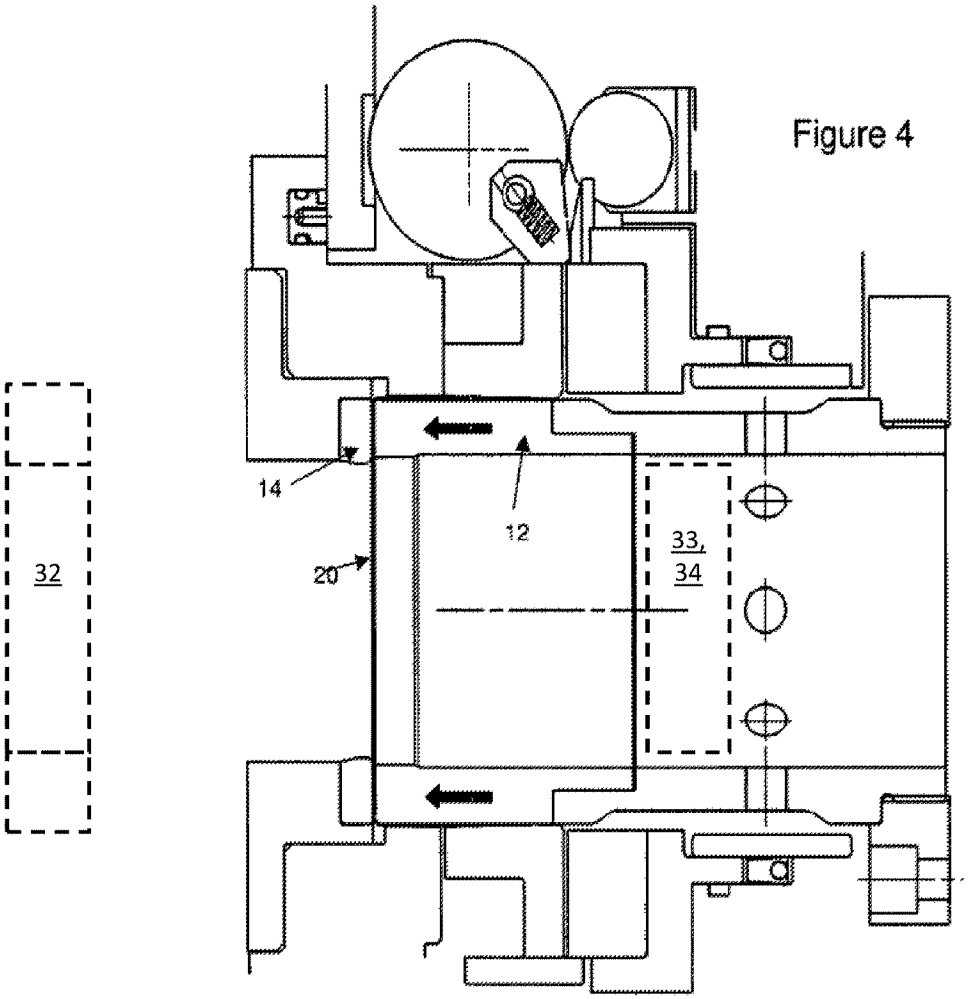
FIG. 4 shows the disc as a blankholder moves forward to form a cup.

In FIG. 2, the second set of rollers 7 grips the disc 5 and drives it downwards into a locator 9 (FIG. 3) which positions the disc centrally to a blank holder (FIG. 4). The pawl 8 at the top would be pushed back as the disc is fed through and then would spring back above the disc. This holds the disc down against the locator. In a first example, only the pawl 8 holds the disc in place once the disc is fed down the centre line.

A hydraulic clamp or draw pad 10 is mounted in the support plate shown in FIG. 3 just below the bottom small roller 7'. When the disc is in position, the draw pad 10 clamps the disc 5 against the draw die 11. In FIG. 4, the blank holder 12 is moving forward as shown by the arrow to turn the disc into a cup 20. The blank holder 12 continues forward to clamp the cup against the redraw die 14. In the example of FIG. 4, the blank holder 12 is mounted on a hydraulic hold down mechanism such as is described in EP 1292405 B (CROWN PACKAGING TECHNOLOGY, INC.). Alternatively, the blank holder could be mounted on a cam-driven mechanism.

Figure 5:
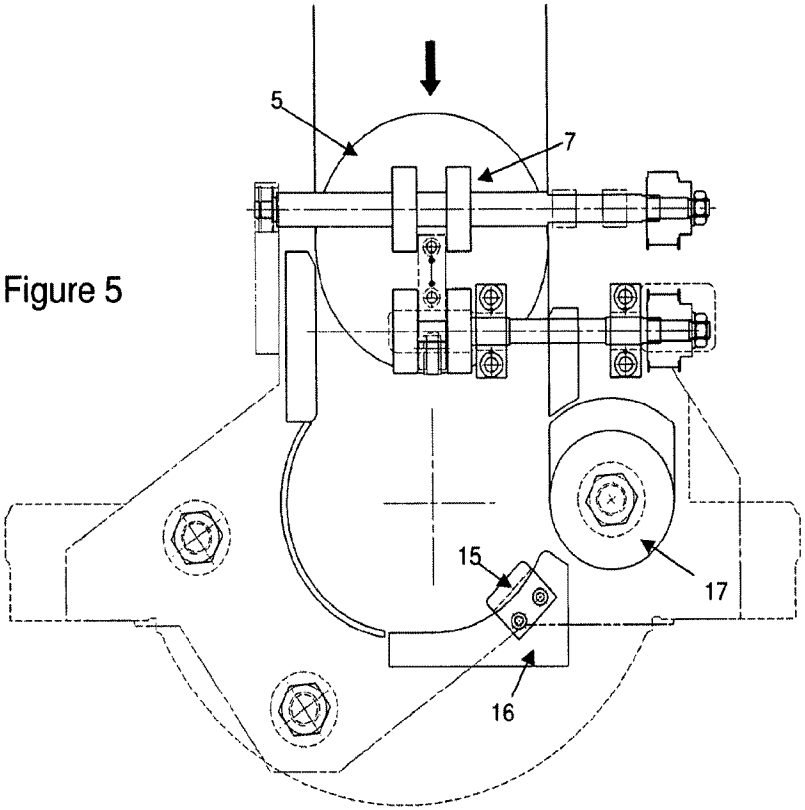
FIG. 5 is the embodiment of FIGS. 1 to 4, with an off-centre feed.
Figure 6:
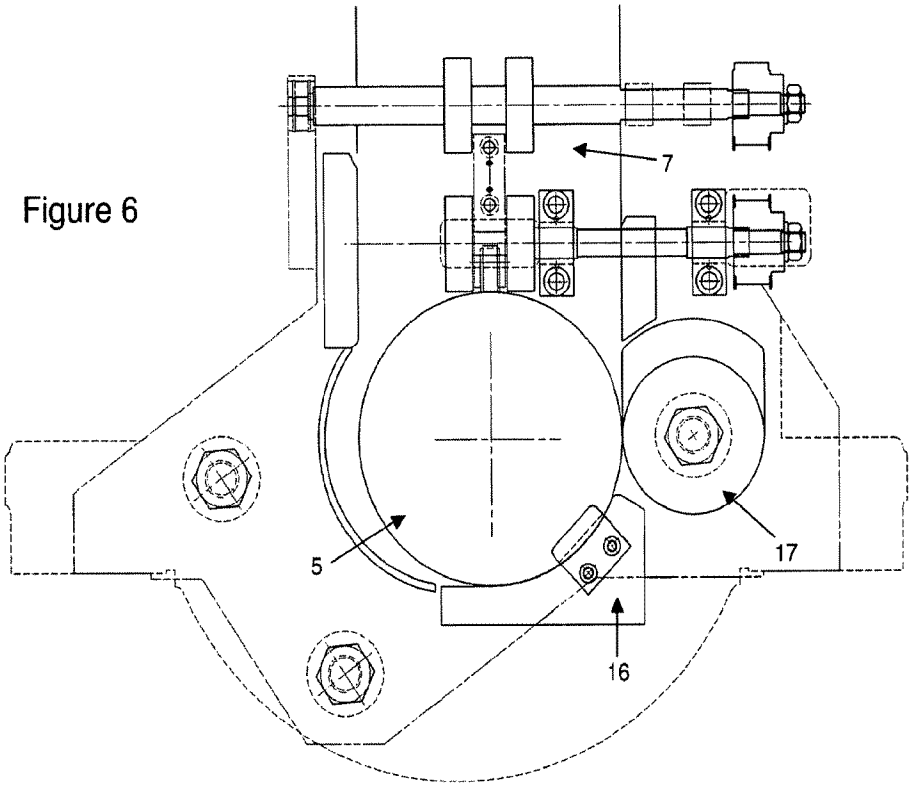
FIG. 6 is the off-centre feed of FIG. 5 with spring-loaded cushion to prevent the disc from bouncing.
Figure 7:
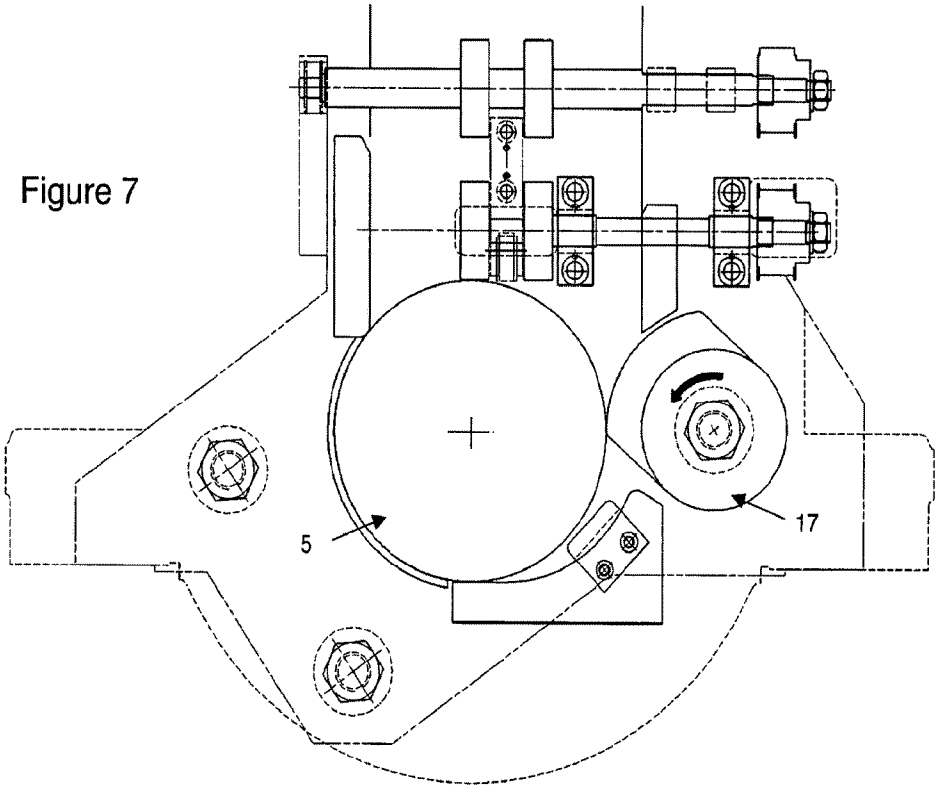
FIG. 7 is the off-centre feed of FIGS. 5 and 6, showing mechanical positioning of the disc by a cam.

The actions of FIGS. 1 to 4 all occur while the ram 33 (which carries the punch 34) on the bodymaker is returning to the back of its stroke. The cup 20 is ironed by carrying the cup through at least one die 32 thereby forming the cup into a can body. FIGS. 5 to 7 demonstrate additional features, which may be necessary for positive location if the disc is travelling quickly and if the pawl 8 is a little slow in reacting. If this happens, the disc 5 might bounce out of position.

In FIG. 5, the disc 5 is fed off-centre by the rollers 7 in order to avoid the draw pad hitting spring-loaded cushion 15. The cushion clamp 16 prevents the disc 5 from bouncing (FIG. 6) while the cam 17 rotates as indicated by the arrow in FIG. 7 in order to position the disc correctly for cup formation.

The invention claimed is:

1. A can bodymarker comprising:

a ram which carries a punch for forming a can from a cup using a forward stroke of the ram;

a disc feed which is adapted to feed a flat metal disc along a feed axis directly into the bodymaker, the bodymaker defining a channel that extends through the bodymaker along a body axis, the body axis being perpendicular to the feed axis, the disc feed being aligned with the bodymaker such that a center of the channel positioned on the body axis is offset from the feed axis, wherein when the disc is fed directly into the bodymaker a center of the disc is off-set from the center of the channel;

a blankholder;

a locator for positioning the disc centrally to the blankholder;

a draw pad for clamping the disc against a draw die; and at least one ironing die, wherein the blankholder is adapted to move towards a redraw die and thus, together with the draw die, form the disc into a cup and clamp the cup against the redraw die thereby allowing the cup to be picked up by the punch on the ram and carried through the redraw die and the at least one ironing die for forming a can body.

2. A can bodymaker comprising:

a ram which carries a punch for forming a can from a cup using a forward stroke of the ram;

a disc feed which is adapted to feed a metal disc along a feed axis directly into the bodymaker, the bodymaker defining a channel that extends through the bodymaker along a body axis, the body axis being perpendicular to the feed axis, the disc feed being aligned with the bodymaker such that a center of the channel positioned on the body axis is offset from the feed axis, wherein when the disc is fed into the bodymaker a center of the disc is off-set from the center of the channel;

a blankholder;

a locator for positioning the disc centrally to the blankholder;

a draw pad for clamping the disc against a draw die;

at least one ironing die; and two sets of rollers that grip and drive the disc to the locator, wherein the blankholder is adapted to move towards a redraw die and thus, together with the draw die, form the disc into a cup and clamp the cup against the redraw die thereby allowing the cup to be picked up by the punch on the ram and carried through the redraw die and the at least one ironing die for forming a can body.

3. The bodymaker according to claims 1, in which the disc feed comprises a feed plate with a spring loaded element that holds the disc against the locator.

4. The bodymaker according to claim 1, in which the disc feed includes a positioning cam and a spring loaded cushion.

5. The bodymaker according to claim 2, in which one or more of the sets of rollers is off-centre.

6. The bodymaker according to claim 3, wherein the spring loaded element is a pawl.

7. The bodymaker according to claim 4, wherein the positioning cam is adapted to rotate and contact the metal disc to align the center of the metal disc with the center of the channel of the bodymaker.

8. A method of forming a can body comprising:

feeding a flat disc along a feed axis directly into a can bodymaker, the bodymaker defining a channel that extends through the bodymaker along a body axis, the body axis being perpendicular to the feed axis, wherein a center of the channel positioned on the body axis is offset from the feed axis, and wherein the disc is fed into the bodymaker such that a center of the disc is off-set from the center of the channel;

positioning the disc centrally to a blankholder;

clamping the disc against a draw die;

moving the blankholder towards a redraw die and thus, together with the draw die, form the disc into a cup;

clamping the cup against the redraw die;

picking up the cup on a punch on a ram;

ironing the cup by carrying the cup through at least one ironing die to form the cup into a can body.

9. The method according to claim 8, in which the feeding step comprises moving the disc from a feed plate through rollers into the bodymaker.

* * * * *